US010767655B2

(12) United States Patent
Fukuyama et al.

(10) Patent No.: US 10,767,655 B2
(45) Date of Patent: Sep. 8, 2020

(54) CENTRIFUGAL COMPRESSOR

(71) Applicant: KABUSHIKI KAISHA TOYOTA JIDOSHOKKI, Aichi-ken (JP)

(72) Inventors: Ryosuke Fukuyama, Kariya (JP); Shogo Ito, Kariya (JP); Kaho Takeuchi, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 201 days.

(21) Appl. No.: 15/928,945

(22) Filed: Mar. 22, 2018

(65) Prior Publication Data

US 2018/0283387 A1 Oct. 4, 2018

(30) Foreign Application Priority Data

Mar. 30, 2017 (JP) ..... 2017-068903

(51) Int. Cl.
*F04D 25/02* (2006.01)
*F04D 17/10* (2006.01)
(Continued)

(52) U.S. Cl.
CPC ..... *F04D 25/02* (2013.01); *F04D 17/10* (2013.01); *F04D 25/028* (2013.01);
(Continued)

(58) Field of Classification Search
CPC .... F04D 25/02; F04D 25/028; F04D 25/0606; F04D 25/06; F04D 17/10; F04D 29/059;
(Continued)

(56) References Cited

U.S. PATENT DOCUMENTS 3,174,352 A * 3/1965 Jekat ..... F16D 3/185 74/410
3,283,614 A * 11/1966 Hewko ..... F16H 13/10 475/195
5,301,771 A * 4/1994 Sishtla ..... F04D 29/063 184/6.16
7,458,369 B2 12/2008 Ozawa
2005/0074339 A1* 4/2005 Asa ..... F04B 27/0895 417/212
2005/0074341 A1* 4/2005 Dairokuno ..... F04D 25/028 417/410.1
(Continued)

FOREIGN PATENT DOCUMENTS

JP 52-82958 6/1977
JP 52-99416 8/1977
(Continued)

*Primary Examiner* — Moshe Wilensky
*Assistant Examiner* — Joshua R Beebe
(74) *Attorney, Agent, or Firm* — Greenblum & Bernstein, P.L.C.

(57) ABSTRACT

A centrifugal compressor includes an electric motor coupled to a low-speed shaft, an impeller, and a speed increaser. The speed increaser includes a ring member, a high-speed shaft, rollers, a speed increaser housing member, a discharge passage, and a partition. The ring member includes a circumferential wall and is rotated when the low-speed shaft rotates. The high-speed shaft is coupled to the impeller. The rollers are located between the circumferential wall and the high-speed shaft. The speed increaser housing member stores oil. The discharge passage discharges oil out of the ring member. The partition is located between the speed increaser housing member and the circumferential wall in the radial direction. Power is transmitted from the low-speed shaft to the high-speed shaft by the ring member and the rollers.

5 Claims, 4 Drawing Sheets

(51) Int. Cl.
*F04D 29/063* (2006.01)
*F04D 29/059* (2006.01)
*F04D 25/06* (2006.01)

(52) U.S. Cl.
CPC ..... *F04D 25/0606* (2013.01); *F04D 29/059* (2013.01); *F04D 29/063* (2013.01); *F04D 25/06* (2013.01)

(58) Field of Classification Search
CPC ..... F04D 29/063; F16D 3/20; F16D 3/221; F16D 2003/2232
See application file for complete search history.

(56) References Cited

U.S. PATENT DOCUMENTS

| | | | | |
|---|---|---|---|---|
| 2006/0060170 | A1* | 3/2006 | Ozawa | F01D 25/20 123/559.1 |
| 2014/0311463 | A1* | 10/2014 | Hayashi | F02B 39/08 123/561 |
| 2016/0281740 | A1 | 9/2016 | Mitsuda et al. | |

FOREIGN PATENT DOCUMENTS

| | | |
|---|---|---|
| JP | 53-82807 | 7/1978 |
| JP | 2006-83713 | 3/2006 |
| JP | 2015-140682 | 8/2015 |
| JP | 2016-183751 | 10/2016 |
| JP | 2016-186238 | 10/2016 |

* cited by examiner

CENTRIFUGAL COMPRESSOR

BACKGROUND ART

The present invention relates to a centrifugal compressor.

Japanese Laid-Open Patent Publication No. 2016-186238 describes an example of a compressor including a speed increaser. One example of a speed increaser includes a ring member, a high-speed shaft, rollers, and a speed increaser chamber. The rotation of a low-speed shaft rotates the ring member. The high-speed shaft is located at the inner side of the ring member. The rollers are located between the ring member and the high-speed shaft in contact with both of the ring member and the high-speed shaft. The speed increaser chamber accommodates the ring member, the high-speed shaft, and the rollers.

In the speed increaser, the location where the rollers contact the ring member and the location where the rollers contact the high-speed shaft need to be oiled to reduce wear and avoid seizure.

The compressor of Japanese Laid-Open Patent Publication No. 2016-186238 includes a reservoir chamber that is separate from the speed increaser chamber and located near the outer surface of a housing. This enlarges the compressor. To avoid enlargement of the compressor, the speed increaser chamber can be configured to also serve as the reservoir chamber. In this case, the ring member will be immersed in the oil that is stored in the speed increaser chamber. This will increase the agitation resistance when the ring member rotates and lower the efficiency of the speed increaser.

SUMMARY

It is an object of the present invention to provide a centrifugal compressor that reduces the agitation resistance.

A centrifugal compressor that solves the above problem is provided with an electric motor coupled to a low-speed shaft, an impeller, and a speed increaser. The speed increaser includes a ring member, a high-speed shaft, a plurality of rollers, a speed increaser housing member, a discharge passage, and a partition. The ring member includes a circumferential wall and is configured to be rotated when the low-speed shaft rotates. The high-speed shaft is located at an inner side of the circumferential wall and coupled to the impeller. The rollers are located between the circumferential wall and the high-speed shaft. The speed increaser housing member stores oil and accommodates the ring member, part of the high-speed shaft, and the rollers. The discharge passage is configured to discharge the oil out of the ring member. The partition is located between an inner surface of the speed increaser housing member and the circumferential wall in a radial direction of the circumferential wall. Power is transmitted from the low-speed shaft to the high-speed shaft by the ring member and the rollers.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE EMBODIMENTS

One embodiment of a centrifugal compressor will now be described. The centrifugal compressor of the present embodiment includes a speed increaser and is installed in a fuel cell vehicle (FCV) that is powered by a fuel cell. The centrifugal compressor supplies the fuel cell with air.

Figure 1:
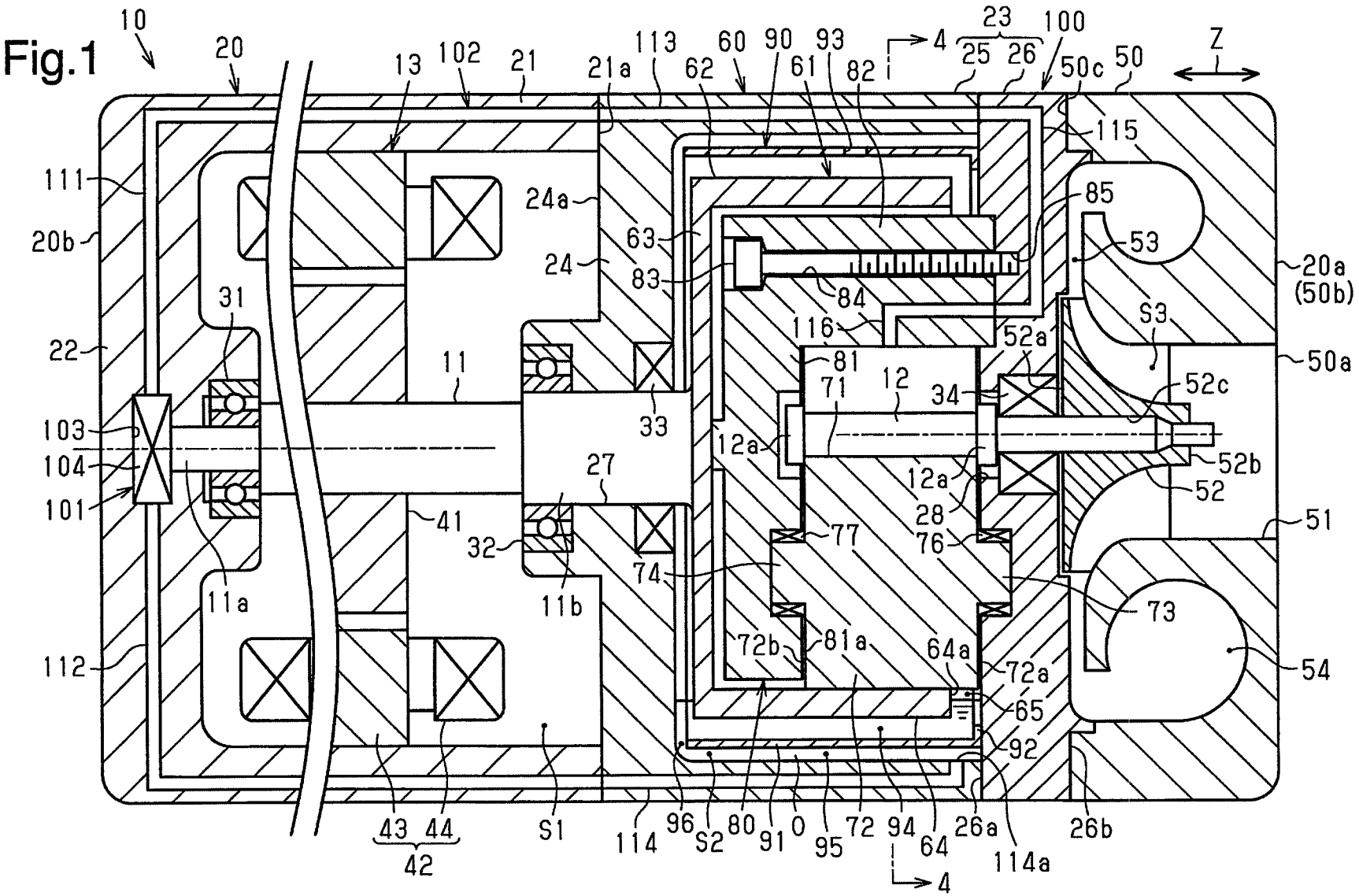
FIG. 1 is a schematic cross-sectional view showing one embodiment of a centrifugal compressor.

As shown in FIG. 1, a centrifugal compressor 10 includes a low-speed shaft 11, a high-speed shaft 12, an electric motor 13 that rotates the low-speed shaft 11, a speed increaser 60, and an impeller 52. The speed increaser 60 increases the rotation speed of the low-speed shaft 11 and transmits the rotation to the high-speed shaft 12. The impeller 52 is rotated by the high-speed shaft 12 to compress fluid (air in the present embodiment). The two shafts 11 and 12 are formed from, for example, a metal, specifically, iron or an iron alloy.

The centrifugal compressor 10 includes a housing 20 that forms the outer shell of the centrifugal compressor 10. The housing 20 accommodates the two shafts 11 and 12, the electric motor 13, and a speed increasing mechanism 61 that forms part of the speed increaser 60. The housing 20 is, for example, substantially tubular (specifically, cylindrical) as a whole.

The housing 20 includes a motor housing member 21 that accommodates the electric motor 13, a speed increaser housing member 23 that accommodates the speed increasing mechanism 61, and a compressor housing member 50 including a suction port 50*a* that draws in fluid. Among the two end surfaces 20*a* and 20*b* of the housing 20 in the axial direction, the suction port 50*a* is located in the first end surface 20*a*. The compressor housing member 50, the speed increaser housing member 23, and the motor housing member 21 are aligned in this order from the side closer to the suction port 50*a* in the axial direction of the housing 20. In the present embodiment, the speed increasing mechanism 61 and the speed increaser housing member 23 form the speed increaser 60.

The motor housing member 21 is tubular (specifically, cylindrical) as a whole and includes a closed end 22 (end wall). The second end surface 20*b* defines the outer surface of the closed end 22 of the motor housing member 21 and is located at the side of the housing 20 opposite to the first end surface 20*a*, which includes the suction port 50*a*. The speed increaser housing member 23 includes a main body 25 and a cover 26. The main body 25 is tubular (specifically, cylindrical) and includes a closed end 24 (end wall). The cover 26 is located at the side opposite to the closed end 24 in the axial direction of the main body 25.

The motor housing member 21 and the speed increaser housing member 23 are coupled to each other with the open end of the motor housing member 21 joined with the closed end 24 of the main body 25. The closed end 24 has an end surface 24*a* covered by the motor housing member 21. The inner surface of the motor housing member 21 and the end surface 24*a* define a motor accommodation chamber S1. The motor accommodation chamber S1 accommodates the electric motor 13. Further, the motor accommodation chamber S1 accommodates the low-speed shaft 11 in a state in which the low-speed shaft 11 is coaxial with the housing 20.

The low-speed shaft 11 is supported by the housing 20 in a rotatable manner. The centrifugal compressor 10 includes a first bearing 31. The first bearing 31 is arranged in the closed end 22 of the motor housing member 21. The low-speed shaft 11 includes a first end 11*a* supported by the first bearing 31. Part of the first end 11*a* is inserted through the first bearing 31 and fitted into the closed end 22 of the motor housing member 21.

The closed end 24 of the main body 25 includes an insertion hole 27 that is slightly larger than a second end lib of the low-speed shaft 11 located at the side opposite to the first end 11*a*. The centrifugal compressor 10 includes a second bearing 32, which is located in the insertion hole 27, and a seal 33. The second end 11*b* of the low-speed shaft 11 is supported by the second bearing 32. The seal 33 restricts the leakage of oil O from the speed increaser housing member 23 to the motor accommodation chamber S1.

The second end 11*b* of the low-speed shaft 11 is inserted into the insertion hole 27 of the main body 25. Part of the low-speed shaft 11 is located in the speed increaser housing member 23.

The electric motor 13 includes a rotor 41 that is fixed to the low-speed shaft 11 and a stator 42 that is located at the radially outer side of the rotor 41. The stator 42 is fixed to the inner surface of the motor housing member 21. The stator 42 includes a cylindrical stator core 43 and a coil 44 wound around the stator core 43. The rotor 41 and the low-speed shaft 11 rotate integrally when current flows to the coil 44.

The cover 26, which is one element of the speed increaser housing member 23, is disk-shaped and has the same diameter as the speed increaser housing member 23. The two sides of the cover 26 in the axial direction respectively define first and second plate surfaces 26*a* and 26*b*. The speed increaser housing member 23 is assembled by joining the open end of the main body 25 with the first plate surface 26*a*. The first plate surface 26*a* of the cover 26 and the inner surface of the speed increaser housing member 23 define a speed increaser chamber S2. The speed increaser chamber S2 accommodates the speed increasing mechanism 61.

The cover 26 includes a cover insertion hole 28 that allows for insertion of the high-speed shaft 12, which forms part of the speed increasing mechanism 61. Part of the high-speed shaft 12 is inserted through the cover insertion hole 28 and located in the compressor housing member 50.

The centrifugal compressor 10 includes a seal 34 located between the high-speed shaft 12 and the wall surface of the cover insertion hole 28. The seal 34 restricts the leakage of the oil 0 from the speed increaser housing member 23 to the compressor housing member 50.

The compressor housing member 50 is substantially tubular and includes a through hole 51 that extends through the compressor housing member 50 in the axial direction. The two axial ends of the compressor housing member 50 respectively define a first end surface 50*b* and a second end surface 50*c*. The first end surface 50*b* of the compressor housing member 50 defines the first end surface 20*a* of the housing 20. The through hole 51 opens in the first end surface 50*b* and functions as the suction port 50*a*.

The compressor housing member 50 and the cover 26 are coupled to each other with the second end surface 50*c* joined with the second plate surface 26*b*. The second end surface 50*c* is the end surface of the compressor housing member 50 at the side opposite to the first end surface 50*b*, and the second plate surface 26*b* is the end surface of the cover 26 at the side opposite to the first plate surface 26*a*. The wall surface of the through hole 51 and the second plate surface 26*b* of the cover 26 define an impeller chamber S3. The impeller chamber S3 accommodates the impeller 52. The through hole 51 functions as the suction port 50*a* and defines the impeller chamber S3. The suction port 50*a* is in communication with the impeller chamber S3.

The through hole 51 has a diameter that is constant from the suction port 50*a* to an intermediate position in the axial direction. The through hole 51 from the intermediate position has the form of a substantially truncated cone of which the diameter gradually increases toward the cover 26. Thus, the impeller chamber S3 defined by the wall surface of the through hole 51 substantially has the form of a truncated cone.

The impeller 52 has a contour that is gradually reduced in diameter from the basal end surface 52*a* toward the distal end surface 52*b*. The impeller 52 includes an insertion hole 52*c* that extends in the axial direction of the impeller 52 and allows for insertion of the high-speed shaft 12. The impeller 52 is coupled to the high-speed shaft 12 with part of the high-speed shaft 12 inserted through the insertion hole 52*c* and projected into the through hole 51. The impeller 52 is rotated integrally with the high-speed shaft 12. Thus, the rotation of the high-speed shaft 12 rotates the impeller 52 and compresses the fluid drawn through the suction port 50*a*.

Further, the centrifugal compressor 10 includes a diffuser passage 53 and a discharge chamber 54. The fluid compressed by the impeller 52 flows into the diffuser passage 53. The fluid that passes through the diffuser passage 53 enters the discharge chamber 54. The through hole 51 includes an open end that opens toward the second plate surface 26*b* of the cover 26 and is continuous with the diffuser passage 53. The diffuser passage 53 is defined by the second plate surface 26*b* and the surface of the compressor housing member 50 opposing the second plate surface 26*b*. The diffuser passage 53 is located outward from the impeller chamber S3 in the radial direction of the high-speed shaft 12 and has a closed shape (specifically, circular shape) so as to surround the impeller 52 and the impeller chamber S3. The discharge chamber 54 has a closed shape and is located outward from the diffuser passage 53 in the radial direction of the high-speed shaft 12. The impeller chamber S3 is in communication with the discharge chamber 54 through the diffuser passage 53. The fluid compressed by the impeller 52 is further compressed in the diffuser passage 53 and then discharged out of the discharge chamber 54.

The speed increaser 60 will now be described. The speed increaser 60 of the present embodiment is of a traction drive type (friction roller type).

Figure 2:
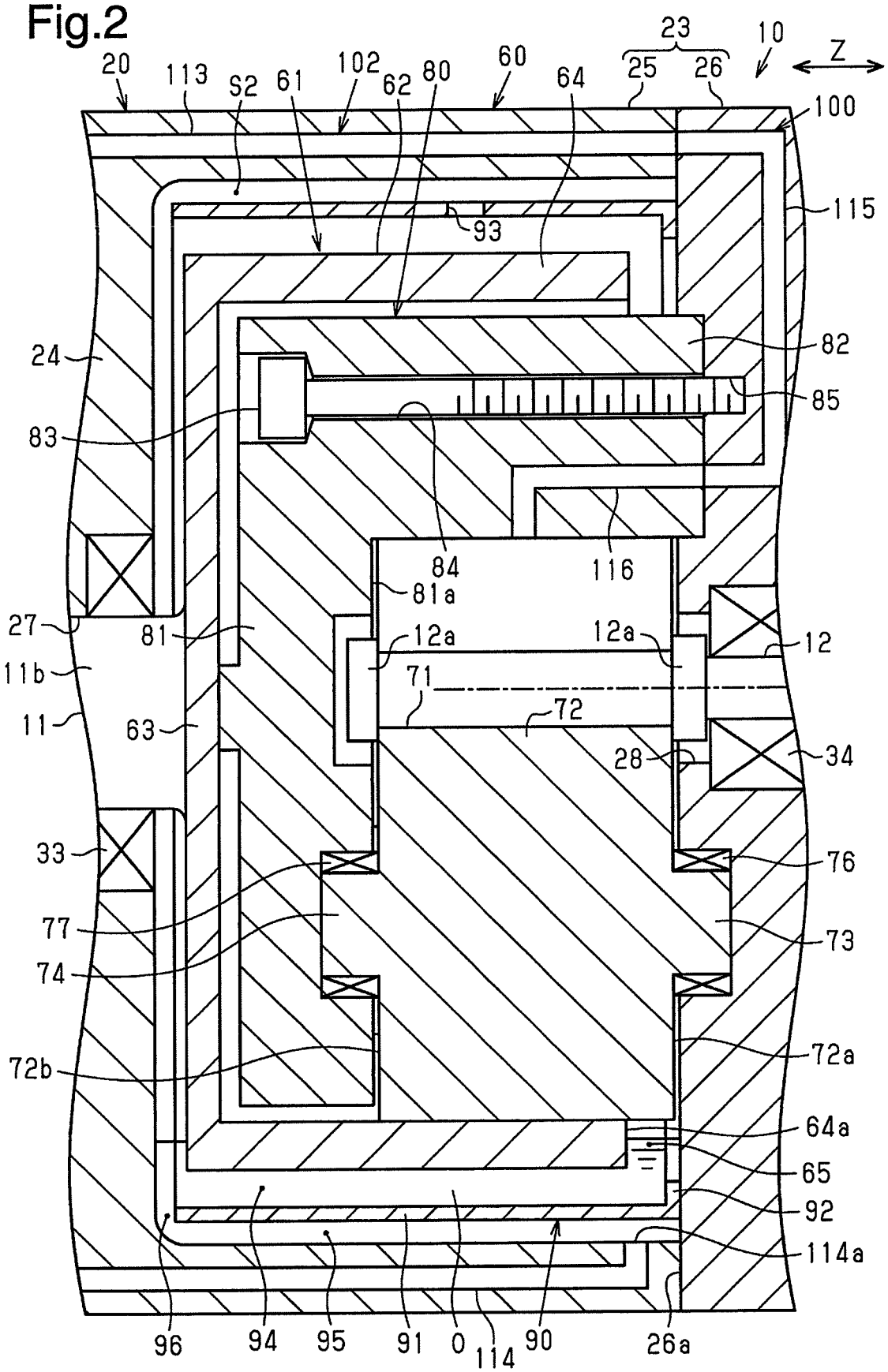
FIG. 2 is an enlarged cross-sectional view of a speed increaser in the centrifugal compressor shown in FIG. 1.
Figure 3:
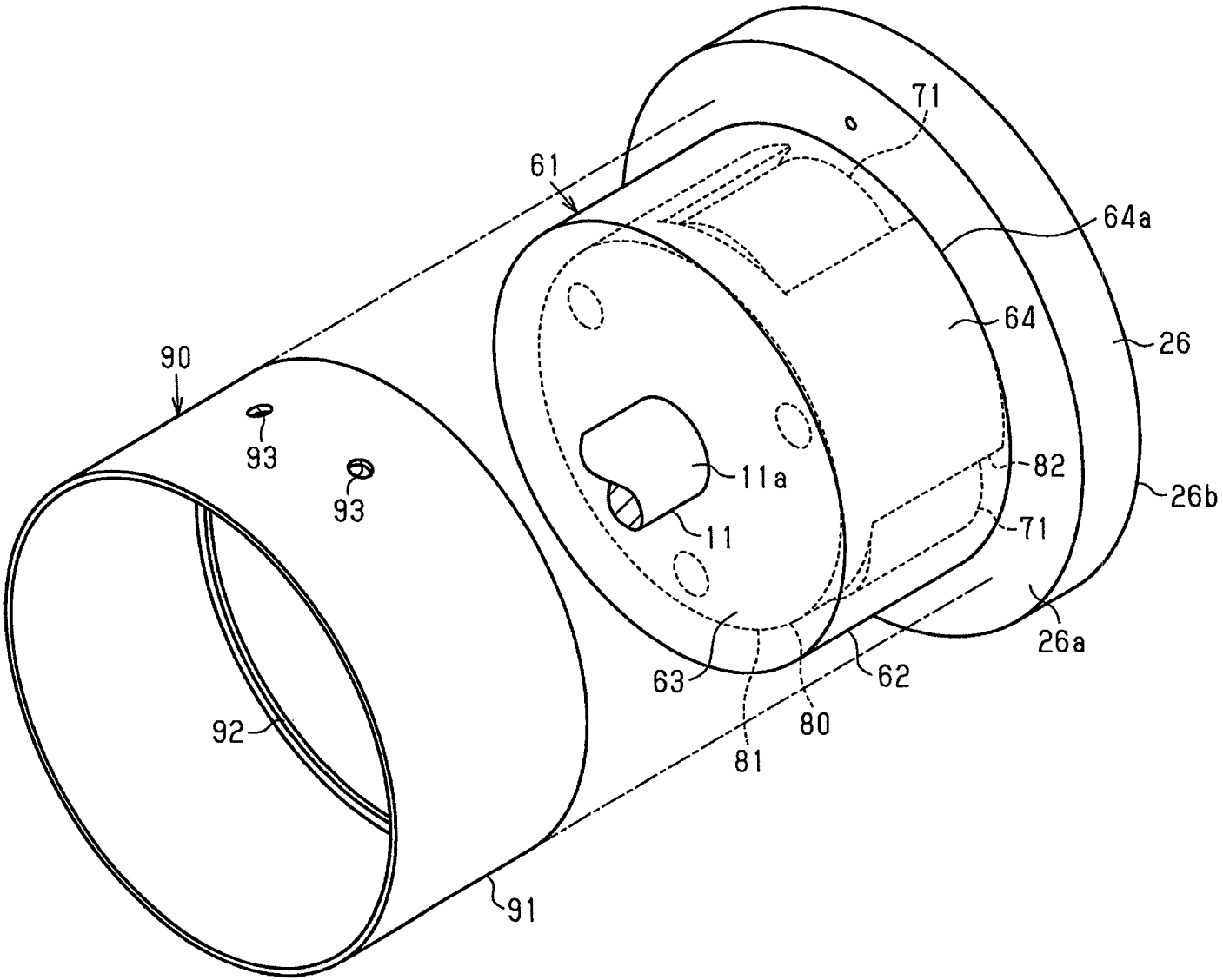
FIG. 3 is a perspective view of a partition in the centrifugal compressor shown in FIG. 1.

As shown in FIGS. 2 and 3, the speed increasing mechanism 61 of the speed increaser 60 includes a ring member 62 that is coupled to the second end 11*b* of the low-speed shaft 11. The ring member 62 includes a disk-shaped base 63 and a circumferential wall 64. The base 63 is coupled to the second end 11*b* of the low-speed shaft 11, and the circumferential wall 64 is ring-shaped and extends in the axial direction from the circumferential edge of the base 63. The circumferential wall 64 has an inner diameter that is larger than the diameter of the second end 11*b* of the low-speed shaft 11.

In the present embodiment, the ring member 62 is coupled to the low-speed shaft 11 in a state in which the base 63 (ring member 62) is coaxial with the low-speed shaft 11. The circumferential wall 64 is also coaxial with the low-speed shaft 11. The rotation of the low-speed shaft 11 rotates the ring member 62.

Part of the high-speed shaft 12 is located at the inner side of the circumferential wall 64. The speed increasing mechanism 61 include three rollers 71 located between the high-speed shaft 12 and the circumferential wall 64 in contact with both of the circumferential wall 64 and the high-speed shaft 12. In the present embodiment, the three rollers 71 are identically shaped. The rollers 71 each include a cylindrical roller portion 72, first and second end surfaces 72*a* and 72*a* in the axial direction of the roller portion 72, a cylindrical first projection 73 that projects from the first end surface 72*a*, and a cylindrical second projection 74 that projects from the second end surface 72*b*. The roller portion 72 is coaxial with the first projection 73 and the second projection 74. The axial direction of the roller portion 72 will hereinafter be referred to as the axial direction Z of the rollers 71.

The roller portion 72 has a diameter (length in direction orthogonal to axial direction Z) that is larger than that of the high-speed shaft 12. The axial direction Z coincides with the rotation axis of the high-speed shaft 12. The rollers 71 are arranged in the circumferential direction of the high-speed shaft 12 spaced apart from one another. The rollers 71 are each formed from, for example, a metal. More specifically, the rollers 71 are formed from the same metal as the high-speed shaft 12, for example, iron or an iron alloy.

Figure 4:
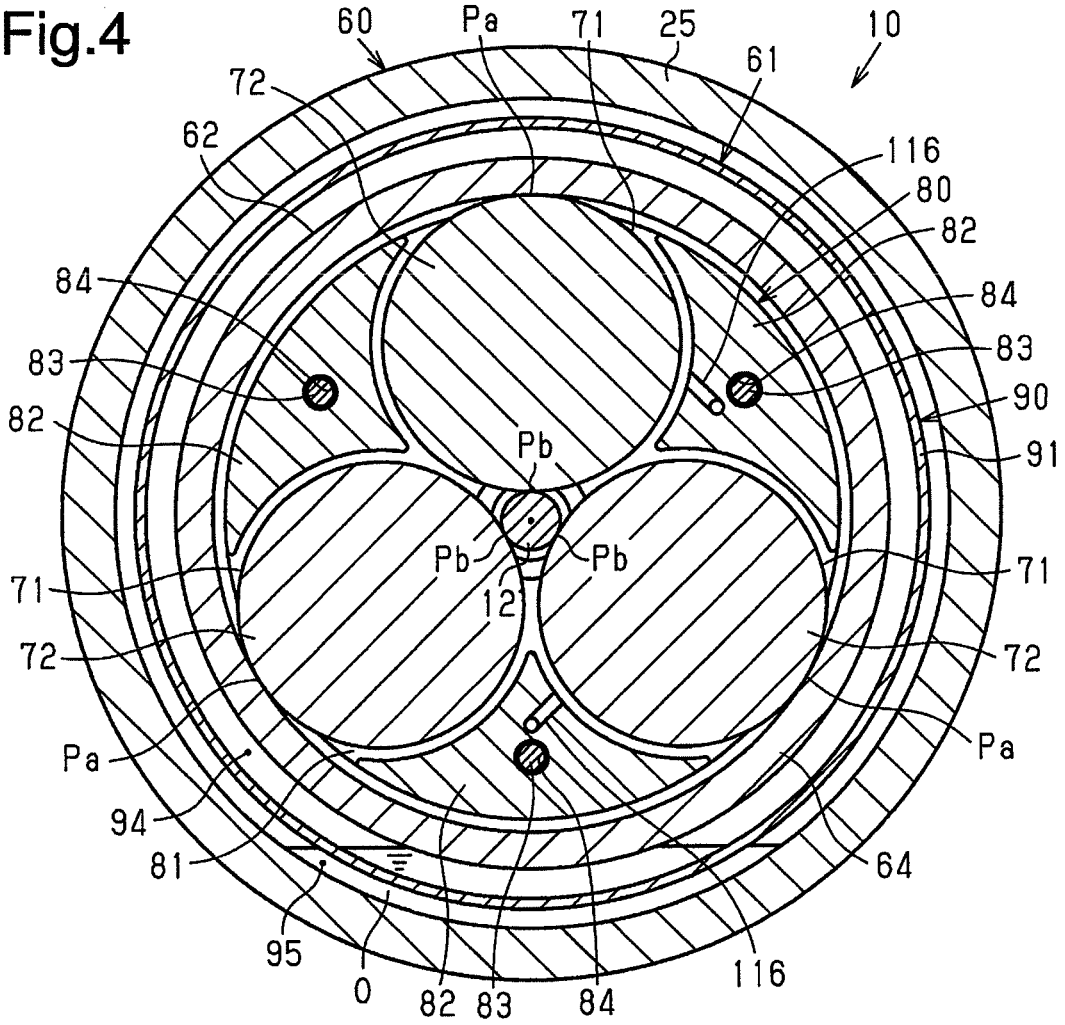
FIG. 4 is a cross-sectional view of the speed increaser shown in FIG. 2 taken along line 4-4 in FIG. 1.

As shown in FIGS. 2 and 4, the speed increasing mechanism 61 includes a support 80. The support 80 cooperates with the cover 26 to support the rollers 71 so that the rollers 71 are rotatable. The support 80 is located at the inner side the circumferential wall 64. The support 80 includes a disk-shaped support base 81 that is slightly smaller in diameter than the circumferential wall 64 and three posts 82 that extend in the axial direction from the support base 81. The support base 81 is opposed to the cover 26 in the axial direction Z. The support base 81 includes an opposing plate surface 81*a* that is opposed to the first plate surface 26*a* of the cover 26. The three posts 82 extend from the opposing plate surface 81*a* toward the cover 26 filling three gaps that are each defined between the inner circumferential surface of the circumferential wall 64 and the outer circumferential surfaces of two adjacent ones of the roller portions 72.

As shown in FIG. 2, the posts 82 each include a bolt hole 84 that allows for insertion of a bolt 83 extending in the axial direction Z. The cover 26 includes threaded holes 85 corresponding to the bolt holes 84. Each bolt hole 84 is in communication with the corresponding threaded hole 85. In a state in which the distal end surfaces of the posts 82 are joined with the first plate surface 26*a*, the posts 82 are fixed to the cover 26 by inserting each bolt 83 through the corresponding bolt hole 84 and fastening the bolt 83 to the corresponding threaded hole 85.

The speed increaser 60 includes first roller bearings 76 and second roller bearings 77 that support the rollers 71 in a rotatable manner. The first roller bearings 76 are arranged in the cover 26. The second roller bearings 77 are arranged in the support base 81. The rollers 71 are supported by the first roller bearings 76 and the second roller bearings 77 so as to be held between the cover 26 and the support base 81.

As shown in FIG. 4, the rollers 71, the ring member 62, and the high-speed shaft 12 form a unit with each roller portion 72 forced against the high-speed shaft 12 and the circumferential wall 64. The high-speed shaft 12 is supported by the three roller portions 72 in a rotatable manner. The location where the outer circumferential surface of each roller portion 72 contacts the inner circumferential surface of the circumferential wall 64 is referred to as the ring contact location Pa, and the location where the outer circumferential surface of each roller portion 72 contacts the circumferential surface of the high-speed shaft 12 is referred to as the shaft contact location Pb. A pressing load is applied to the ring contact locations Pa and the shaft contact locations Pb. The contact locations Pa and Pb each extend in the axial direction Z.

As shown in FIG. 1, the high-speed shaft 12 includes two flanges 12*a* that are spaced apart and opposed to each other in the axial direction of the high-speed shaft 12. Each roller portion 72 is held between the two flanges 12*a* in the axial direction. This restricts displacement of the high-speed shaft 12 and the roller portions 72 in the axial direction of the high-speed shaft 12.

As shown in FIG. 2, in a state in which the speed increaser 60 is fixed to the cover 26, a discharge passage 65 is defined between an end surface 64*a* of the open end of the circumferential wall 64 and the first plate surface 26*a* of the cover 26. The inner and outer sides of the circumferential wall 64 are in communication through the discharge passage 65.

As shown in FIG. 1, the centrifugal compressor 10 includes an oil supplying mechanism 100 that supplies the oil O to the speed increasing mechanism 61. The oil supplying mechanism 100 includes a pump 101 and an oil passage 102. The pump 101 is driven so that the oil O circulates through the oil passage 102 and flows to the speed increaser chamber S2.

The pump 101 is arranged in the closed end 22 of the motor housing member 21. The pump 101 of the present embodiment is of a displacement type. The pump 101 includes an accommodation portion 103, which is located in the closed end 22, and a rotation body 104. The first end 11*a* of the low-speed shaft 11 is coupled to the rotation body 104.

The motor housing member 21 includes a first oil conduit 111 and a second oil conduit 112 that form part of the oil passage 102. The first oil conduit 111 includes a first end that opens in the accommodation portion 103 and a second end that opens in an end surface 21*a* of the open end of the motor housing member 21 at a location where the end surface 21*a* contacts the end surface 24*a*. The second oil conduit 112 includes a first end that opens in the accommodation portion 103 and a second end that opens in the end surface 21*a* of the motor housing member 21 at a location where the end surface 21*a* contacts the end surface 24*a*.

The main body 25 includes a third oil conduit 113 and a fourth oil conduit 114 that form part of the oil passage 102. The third oil conduit 113 opens in the two axial end surfaces of the main body 25. The third oil conduit 113 includes a first end that opens in the end surface of the main body 25 at a position opposing the second end of the first oil conduit 111 and is in communication with the first oil conduit 111. The fourth oil conduit 114 includes a first end that opens in the end surface of the main body 25 at a position opposing the second end of the second oil conduit 112 and is in communication with the second oil conduit 112. The fourth oil conduit 114 also includes a second end defining an opening 114*a* that opens in the inner circumferential surface of the main body 25.

The cover 26 includes a fifth oil conduit 115 that forms part of the oil passage 102. The fifth oil conduit 115 includes a first end that opens in the first plate surface 26*a* at a position opposing a second end of the third oil conduit 113 and is in communication with the third oil conduit 113. The fifth oil conduit 115 also includes a second end that opens in the first plate surface 26*a* at a position opposing the posts 82.

The posts 82 include a sixth oil conduit 116 that forms part of the oil passage 102. The sixth oil conduit 116 includes a first end that opens in the end surfaces of the posts 82 at a position opposing the second end of the fifth oil conduit 115 and is in communication with the fifth oil conduit 115. The sixth oil conduit 116 also includes a second end that opens in the outer surfaces of the posts 82 at a position opposing the roller portion 72. Although not shown in the drawings, there are two fifth oil conduits 115 and two sixth oil conduits 116 branched from the third oil conduit 113. The oil O is supplied to the inside of the ring member 62 through the sixth oil conduit 116 that extends through two of the three posts 82.

The centrifugal compressor 10 is used with the portion inside the speed increaser housing member 23 that is in communication with the fourth oil conduit 114 located at the lowermost position in the vertical direction. The opening 114*a* of the fourth oil conduit 114 is directed upward in the vertical direction. Gravitational force stores the oil O inside the speed increaser housing member 23 at the location that is in communication with the fourth oil conduit 114.

When the pump 101 is driven, the oil O sequentially flows through the fourth oil conduit 114, the second oil conduit 112, the accommodation portion 103, the first oil conduit 111, the third oil conduit 113, the fifth oil conduit 115, and the sixth oil conduit 116. The oil O that flows to the sixth oil conduit 116 is supplied to the inside of the ring member 62 to lubricate the rollers 71. The oil O is discharged out of the ring member 62 through the discharge passage 65. The oil O discharged out of the ring member 62 collects in the speed increaser chamber S2. The speed increaser chamber S2 functions as a reservoir chamber that stores the oil O. The lower portion of the ring member 62 is immersed in the oil O inside the speed increaser chamber S2. Thus, when the ring member 62 rotates, the oil O increases the rotation resistance of the ring member 62.

With the above structure, the rotation of the rollers 71 forms a thin film of the oil O that is solidified, or an elastohydrodynamic lubrication (EHL) film, at the ring contact locations Pa and the shaft contact locations Pb. In other words, a thin film of the oil O exists between the circumferential surface of each roller portion 72 and the inner circumferential portion of the circumferential wall 64. In the same manner, a thin film of the oil O that is solidified exists between the circumferential surface of the high-speed shaft 12 and the circumferential surface of each roller portion 72. The thin film of the solidified oil O between the circumferential surface of the high-speed shaft 12 and the circumferential surface of each roller portion 72 transmits the rotation force of the roller 71 to the high-speed shaft 12 and consequently rotates the high-speed shaft 12. The circumferential wall 64 rotates at the same speed as the low-speed shaft 11, and the rollers 71 each rotate at a higher speed than the low-speed shaft 11. Further, the high-speed shaft 12, which is smaller in diameter than each roller portion 72, is rotated at a higher speed than the roller portion 72. In this manner, the speed increaser 60 rotates the high-speed shaft 12 at a higher speed than the low-speed shaft 11. The speed increaser 60 connects the impeller 52, which is coupled to the high-speed shaft 12, and the electric motor 13, which rotates the low-speed shaft 11.

When the ring member 62 rotates, the circumferential wall 64 lifts and agitates the oil 0 in the speed increaser chamber S2. To reduce the agitation resistance, the speed increaser 60 of the present embodiment includes a partition 90.

As shown in FIGS. 2 and 3, the partition 90 includes a ring-shaped partition body 91 and a ring-shaped partition flange 92. The partition flange 92 extends from a first axial end of the partition body 91. The partition 90 includes openings through which the inner and outer sides of the partition 90 are in communication, more specifically, holes 93 that extend through the partition body 91 in the radial direction. The discharge passage 65 and the holes 93 are laid out at non-overlapping positions in the radial direction and axial direction of the circumferential wall 64.

The partition body 91 is longer than the ring member 62 in the axial direction. The partition body 91 is shorter than the speed increaser chamber S2 in the axial direction Z, that is, shorter than the distance between the inner surfaces of the speed increaser housing member 23 opposed in the axial direction Z. The inner diameter of the partition body 91 is larger than the outer diameter of the circumferential wall 64 of the ring member 62.

The partition 90 is coupled to the speed increaser housing member 23 by fastening the partition flange 92 to the cover 26 with bolts (not shown). The partition 90 is located between the outer circumferential surface of the ring member 62 and the inner circumferential surface of the speed increaser housing member 23. The partition 90 is arranged in concentricity with the partition body 91 and the ring member 62. The partition 90 is located between the opening 114*a* and the ring member 62 (circumferential wall 64) so as to block the opening 114*a* from the ring member 62.

The speed increaser 60 includes a communication passage 96 extending between a second axial end of the partition body 91, which is the one of the two axial ends located at the side opposite to the partition flange 92, and the closed end 24 of the main body 25. In the description hereafter, the radial direction refers to the radial direction of the high-speed shaft 12. The radial direction of the partition 90 coincides with the radial direction of the circumferential wall 64 and the radial direction of the high-speed shaft 12. Further, the axial direction refers to the axial direction of the high-speed shaft 12. The axial direction of the partition 90 coincides with the axial direction of the circumferential wall 64, the axial direction of the high-speed shaft 12, and the axial direction of the rollers 71.

In the speed increaser chamber S2, the region extending radially inward from the partition 90 defines an agitation region 94 and the region extending radially outward from the partition 90 defines a reservoir region 95. The agitation region 94 and the reservoir region 95 are in communication through the communication passage 96. Further, the agitation region 94 and the reservoir region 95 are in communication through the holes 93. The reservoir region 95 is in communication with the fourth oil conduit 114. The oil O discharged out of the ring member 62 through the discharge passage 65 enters the agitation region 94. The oil O then flows through the communication passage 96 and the holes 93 to the reservoir region 95. The size of the communication passage 96 and the number and area of the holes 93 are determined in accordance with the displacement of the pump 101 and the lubrication properties required for the speed increaser 60.

The operation of the speed increaser 60 and the centrifugal compressor 10 in the present embodiment will now be described.

When the electric motor 13 is driven, the rotation of the low-speed shaft 11 drives the pump 101 and supplies the oil O to the inside of the ring member 62. The oil O supplied to the inside of the ring member 62 is discharged out of the ring member 62 through the discharge passage 65. The rotation of the ring member 62 agitates the oil O as the circumferential wall 64 lifts the oil O that has been discharged out of the ring member 62 through the discharge passage 65. During the rotation of the ring member 62, centrifugal force scatters the agitated oil O outward in the radial direction. The oil O is scattered throughout the agitation region 94. The partition 90 restricts radially outward scattering of the oil O beyond the partition 90. Accordingly, the partition 90 reduces the force of the oil O. The oil O is discharged out of the agitation region 94 through the communication passage 96 and into the reservoir region 95. The oil O is also discharged out of the holes 93 into the reservoir region 95.

The oil O agitated by the ring member 62 is primarily the oil O in the agitation region 94. The amount of oil O agitated by the rotation of the ring member 62 is limited in the reservoir region 95. Accordingly, the absolute amount of the oil O agitated by the rotation of the ring member 62 is less than that when the partition 90 is not present.

Further, by limiting the agitated amount of the oil O in the reservoir region 95, less gas is contained in the oil O. Without the partition 90, when the oil O is entirely agitated in the speed increaser chamber S2, the oil O will entirely contain gas. Consequently, the pump 101 will pump the oil O that contains gas. This will reduce the flow rate of the pump 101. In contrast, the pump 101 of the present embodiment pumps the oil O that includes a limited amount of gas from the reservoir region 95. This avoids situations in which the oil O reduces the flow rate.

In addition, the rotation of the ring member 62 applies force acting in the rotation direction of the ring member 62 to the oil O that is agitated in the agitation region 94. Thus, the agitation resistance is small in the agitation region 94.

The present embodiment has the advantages described below.

(1) The partition 90 restricts radially outward scattering of the oil O agitated by the ring member 62. This reduces the force of the oil O and limits disturbance in the flow of the oil O in the speed increaser chamber S2. Disturbance in the flow of the oil O is one factor that increases the agitation resistance. Thus, the agitation resistance can be decreased by limiting disturbance in the flow of the oil O.

(2) The partition body 91 has a closed shape and separates the agitation region 94 from the reservoir region 95. Thus, the absolute amount of the oil O agitated by the rotation of the ring member 62 is less than that when the partition 90 is not present. This decreases the agitation resistance of the oil O.

(3) The partition body 91 includes the holes 93. Thus, the oil O flows through the holes 93 from the agitation region 94 to the reservoir region 95. The flow of the oil O from the agitation region 94 to the reservoir region 95 reduces the oil amount in the agitation region 94 and decreases the agitation resistance. Further, since the oil O flows through the holes 93, the force of the oil O is weakened when the oil O exits the holes 93. This limits disturbance in the flow of the oil O.

(4) The discharge passage 65 and the holes 93 are non-overlapped in the radial and axial directions of the circumferential wall 64. Thus, the oil O discharged from the discharge passage 65 easily strikes the inner circumferential surface of the circumferential wall 64. Accordingly, the oil O discharged out of the ring member 62 easily flows into the agitation region 94. Further, the oil O discharged out of the discharge passage 65 does not directly flow to the reservoir region 95. This limits disturbance in the flow of the oil O.

(5) The second end of the fourth oil conduit 114 serves as the opening 114*a* that opens in the inner circumferential surface of the speed increaser housing member 23 (main body 25). The partition 90 is located between the opening 114*a* and the ring member 62 (circumferential wall 64) to block the opening 114*a* from the ring member 62. This prevents the agitated oil O from being directly discharged out of the speed increaser housing member 23 and limits the amount of gas that the oil O entirely contains.

It should be apparent to those skilled in the art that the present invention may be embodied in many other specific forms without departing from the spirit or scope of the invention. Particularly, it should be understood that the present invention may be embodied in the following forms.

The positions of the holes 93 may be changed. For example, the holes 93 may be located at positions opposing the discharge passage 65. Further, the holes 93 may be located in a vertically lower or upper portion of the partition body 91 at any position in the horizontal direction.

Figure 5:
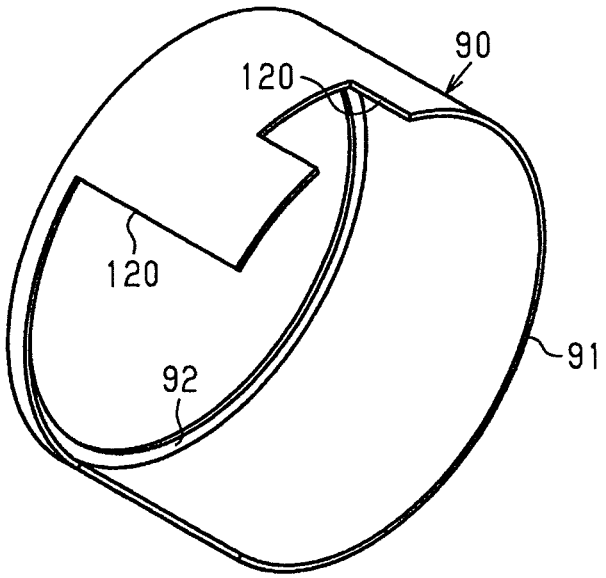
FIG. 5 is a perspective view showing a modified example of the partition.

As shown in FIG. 5, a modified example of the partition body 91 may include an opening 120 that is a cutout extending in the axial direction from the axial end located at the side opposite to the partition flange 92. The opening 120 of the partition body 91 may extend over the entire partition body 91 in the axial direction. Further, the partition body 91 may include multiple openings 120 having different dimensions.

As long as the partition body 91 includes the holes 93, the communication passage 96 does not have to be formed. That is, the axial dimension of the partition body 91 may be the same as that of the speed increaser chamber S2. Even in this case, the oil O flows from the agitation region 94 to the reservoir region 95 through the holes 93.

The discharge passage 65 and the holes 93 may be laid out to partially overlap one another in at least one of the radial and axial directions of the circumferential wall 64.

The partition body 91 does not have to include the holes 93.

The partition 90 may be fixed to the closed end 24 of the main body 25.

The region between the cover 26 and the circumferential wall 64 defines the discharge passage 65. Instead, the circumferential wall 64 may include a hole that defines a discharge passage.

The fifth oil conduit 115 and the sixth oil conduit 116 may be changed in number. For example, the oil O may be supplied from every one of the posts 82. Alternatively, the oil O may be supplied from only one of the posts 82.

The partition body 91 may have a closed shape that is not the shape of a ring. For example, the closed shaped may be a polygon such as a tetragon.

The partition body 91 does not need to have a closed shape. For example, a partition body may extend over only one circumferential half of the partition body 91 in the circumferential direction. In this case, the partition body 91 is semicircular. It is also desirable in this case that the partition body 91 be located at a vertically lower position in the speed increaser chamber S2.

The pump does not have to be incorporated in the centrifugal compressor and may be an external pump.

The rollers 71 may be changed in number. For example, the number of the rollers 71 may be four or five.

The speed increaser 60 may use a wedge effect. In this case, at least one of the rollers is a movable roller moved by the rotation of the ring member 62.

The centrifugal compressor 10 may be applied to any subject, and the subject compressed by the centrifugal compressor 10 may be any fluid. For example, the centrifugal compressor 10 may be used in an air conditioner, and the fluid that is subject to compression may be a refrigerant. Further, the centrifugal compressor 10 does not have to be installed in a vehicle and may be installed in any subject.

The present examples and embodiments are to be considered as illustrative and not restrictive, and the invention is not to be limited to the details given herein, but may be modified within the scope and equivalence of the appended claims.

What is claimed is:

1. A centrifugal compressor comprising:

an electric motor coupled to a low-speed shaft;

an impeller; and a speed increaser including:

a ring member including a circumferential wall and configured to be rotated when the low-speed shaft rotates, a high-speed shaft located at an inner side of the circumferential wall and coupled to the impeller, a plurality of rollers located between the circumferential wall and the high-speed shaft, a speed increaser housing member including a tubular main body that accommodates the ring member, part of the high-speed shaft, and the rollers and stores oil so that a lower portion of the ring member is immersed in the oil, a discharge passage configured to discharge the oil out of the ring member, a partition located between an inner circumferential surface of the main body and the lower portion of the ring member in a radial direction of the circumferential wall, a reservoir region, in which the oil is reserved, defined between the partition and the inner circumferential surface of the main body, an agitation region, in which the oil is agitated by the ring member, defined between the partition and the lower portion of the ring member, a communication passage for discharging the oil in the agitation region to the reservoir region, and an oil passage having an opening that opens in the inner circumferential surface of the main body so as to communicate with the reservoir region, wherein the agitation region has a first end in the axial direction of the circumferential wall that communicates with the discharge passage, and a second end in the axial direction that communicates with the communication passage, the opening of the oil passage is located at a position closer to the discharge passage than the communication passage in the axial direction, and power is transmitted from the low-speed shaft to the high-speed shaft by the ring member and the rollers.

2. The centrifugal compressor according to claim 1, wherein the partition has a closed shape to surround the ring member.

3. The centrifugal compressor according to claim 2, wherein the partition includes an opening through which outer and inner sides of the partition are in communication.

4. The centrifugal compressor according to claim 3, wherein the the opening of the partition is located between the communication passage and the opening of the oil passage in the axial direction.

5. The centrifugal compressor according to claim 1, wherein the speed increaser housing member includes the oil passage, and the partition is located between the opening of the oil passage and the circumferential wall to block the opening of the oil passage from the circumferential wall.

* * * * *